US009715198B2

(12) United States Patent
Hase et al.

(10) Patent No.: US 9,715,198 B2
(45) Date of Patent: Jul. 25, 2017

(54) FIXING DEVICE AND IMAGE FORMING APPARATUS

(71) Applicants: Takamasa Hase, Shizuoka (JP); Hiroshi Yoshinaga, Chiba (JP); Takeshi Uchitani, Kanagawa (JP); Yutaka Ikebuchi, Kanagawa (JP); Takuya Seshita, Kanagawa (JP); Shuutaroh Yuasa, Kanagawa (JP)

(72) Inventors: Takamasa Hase, Shizuoka (JP); Hiroshi Yoshinaga, Chiba (JP); Takeshi Uchitani, Kanagawa (JP); Yutaka Ikebuchi, Kanagawa (JP); Takuya Seshita, Kanagawa (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/013,807

(22) Filed: Feb. 2, 2016

(65) Prior Publication Data

US 2016/0147185 A1 May 26, 2016

Related U.S. Application Data

(63) Continuation of application No. 14/584,728, filed on Dec. 29, 2014, now Pat. No. 9,285,724, which is a (Continued)

(30) Foreign Application Priority Data

Jan. 13, 2012 (JP) ..... 2012-005168
Feb. 2, 2012 (JP) ..... 2012-020897

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2017; G03G 15/2042; G03G 2215/2035
See application file for complete search history.

(56) References Cited

U.S. PATENT DOCUMENTS 7,773,931 B2 8/2010 Jung et al.
8,213,819 B2 7/2012 Nakatani et al.
(Continued)

FOREIGN PATENT DOCUMENTS

CN 101581905 A 11/2009
CN 101673078 A 3/2010
(Continued)

OTHER PUBLICATIONS

Chinese Office Action issued Dec. 24, 2014, in China Patent Application No. 201310001494.0.
(Continued)

*Primary Examiner* — Gregory H Curran
(74) *Attorney, Agent, or Firm* — Oblon, McClelland, Maier & Neustadt, L.L.P.

(57) ABSTRACT

A fixing device includes a rotary endless fixing belt; a nip forming member disposed in an interior of the fixing belt; a rotary opposed member to contact the nip forming member via the fixing belt to form a nip together with the fixing belt; a heat source to directly heat the fixing belt at a portion other than the nip, including at lease one heat-generation part disposed outside lateral ends of a maximum area of the fixing belt where a recording medium passes through, wherein a recording medium carrying an unfixed image is conveyed to the nip and the fixing device fixes the unfixed image onto the recording medium; and a shielding member
(Continued)

disposed between the fixing belt and the heat generation part of the heat source and configured to shield heat from the heat source at least at an area outside the maximum passing area of the recording medium.

27 Claims, 10 Drawing Sheets

Related U.S. Application Data continuation of application No. 13/738,388, filed on Jan. 10, 2013, now Pat. No. 9,042,799.

(56) References Cited

U.S. PATENT DOCUMENTS

2007/0292175 A1 12/2007 Shinshi
2009/0092423 A1* 4/2009 Shin ..... G03G 15/2064 399/329
2009/0110451 A1 4/2009 Jung et al.
2009/0148205 A1 6/2009 Seo et al.
2009/0245865 A1 10/2009 Shinshi et al.
2009/0245897 A1 10/2009 Seo et al.
2009/0297197 A1 12/2009 Hase
2010/0061753 A1 3/2010 Hase
2010/0061754 A1 3/2010 Ishigaya et al.
2010/0067929 A1 3/2010 Seki
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085832 A1 4/2011 Hasegawa et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176821 A1 7/2011 Hase
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.

FOREIGN PATENT DOCUMENTS

JP 06-138789 A 5/1994
JP 2002-214953 A 7/2002
JP 2007-079040 3/2007
JP 2007-233011 9/2007
JP 2007-334205 12/2007
JP 2008-065002 3/2008
JP 2008-129517 6/2008
JP 2008-139779 6/2008
JP 2009-48105 A 3/2009
JP 2010-26058 A 2/2010
JP 2010-032625 2/2010
JP 2010-066376 3/2010
JP 2010-066583 3/2010
JP 2010-107557 5/2010

OTHER PUBLICATIONS

Office Action issued Mar. 24, 2015 in Japanese Patent Application No. 2012-020897.
Office Action issued on Jul. 21, 2015 in Japanese Patent Application No. 2015-104634.

* cited by examiner

FIXING DEVICE AND IMAGE FORMING APPARATUS

CROSS-REFERENCE TO RELATED APPLICATIONS

The present application is a continuation application of U.S. application Ser. No. 14/584,728, filed Dec. 29, 2014, which is a continuation application of U.S. application Ser. No. 13/738,388, filed on Jan. 10, 2013, which claims priority from Japanese patent application numbers 2012-005168 and 2012-020897, filed on Jan. 13, 2012 and Feb. 2, 2012, respectively, the entire disclosures of each of the above are incorporated herein by reference.

BACKGROUND OF THE INVENTION

1. Field of the Invention

The present invention relates to a fixing device and an image forming apparatus including the fixing device.

2. Description of the Related Art

As a fixing device employed in an image forming apparatus such as a copier, a printer, a facsimile machine, or a multi-function apparatus having one or more capabilities of the above devices, a thin fixing belt formed of a metal base and a resin rubber surface layer or the like is known. Using such a thin-layered fixing belt with a low thermal capacity can drastically reduce the energy necessary for heating the fixing belt, enabling warm-up time or a first print time (time to first print) to be reduced. Herein, the warm-up time means the time required to raise the temperature of the fixing belt from power-on to a printable state. The first print time is the time required from receipt of a print request to completion of a printing operation and subsequent media discharge.

FIG. 13 shows a conventional fixing device as disclosed in JP-2007-334205-A, which includes an endless belt 100 as a fixing belt; a pipe-shaped conductive member 200 formed of metal disposed inside the endless belt 100; a heat source 300 disposed inside the metal conductive member 200; a pressure roller 400 contacting the metal conductive member 200 via the endless belt 100, thereby forming a nip N between the metal conductive member 200 and the pressure roller 400. The same also discloses that the endless belt 100 rotates accompanied by a rotation of the pressure roller 400 and the metal conductive member 200 guides a movement of the endless belt 100. Further, the heat source 300 inside the metal conductive member 200 heats the endless belt 100 via the metal conductive member 200, and thus, the entire endless belt 100 can be heated. With this structure, the first print time from the heating standby time can be shortened and any shortage of thermal capacity in high-speed printing can be remedied.

JP-2007-233011-A discloses an alternative method to heat the fixing belt directly, without the metal conductive member intermediary, to realize more energy saving and first print time shortening. Thus, as illustrated in FIG. 14, the pipe-shaped metal conductive member is removed from an interior of the endless belt 100. Instead, a planar nip forming member 500 is disposed at a position opposite the pressure roller 400. In this case, because the endless belt 100 can be directly heated by the heat source 300 at a position at which the nip forming member 500 is not disposed, the heating efficiency is drastically improved and the consumed electricity is decreased. With this structure, the first print time from the heating standby time can be further shortened and can result in a cost reduction.

However, if the fixing belt is directly heated as in continuous printing, the temperature of the fixing belt is excessively increased at a portion where the sheet is not passed, that is, a non-sheet passing portion.

JP-2010-66583-A discloses an approach to solve the problem of excessive heating of the fixing belt, in which a shielding member is disposed between the heat source and the fixing belt. The shielding member moves in the sheet width direction so that a heating area of the fixing belt is variably changed and an appropriate heating area is obtained.

However, because the heat source such as a halogen heater has a characteristic in which heating power is reduced at an edge portion thereof, if the heat length is set at the same area as the sheet passing area, the heat distribution is such that the edge portions of the sheet passing area when the printing is started are cooler than the center portion. Accordingly, a heating area of the halogen heater is set to be longer than the sheet passing area of a regular size sheet so that the area with a constant heat power is coincident with the sheet passing area. Thus, fixability at an edge portion even in the first print can be secured. However, if regular size sheets are continuously printed, even though the heat amount in the extended portion of the heater is small, the temperature of the fixing belt is increased excessively and exceeds the permissible range for the fixing belt because heat is not absorbed by the sheet.

SUMMARY OF THE INVENTION

The present invention provides an optimal fixing device capable of preventing an excessive temperature rise in the non-printing area and an image forming apparatus including such a fixing device. The fixing device includes: a rotary endless fixing belt; a nip forming member disposed in an interior of the fixing belt; a rotary opposed member so disposed as to contact the nip forming member via the fixing belt to form a nip together with the fixing belt; a heat source to directly heat the fixing belt at a portion other than the nip, including at lease one heat-generation part disposed outside lateral ends of a maximum area of the fixing belt where a recording medium passes through, wherein a recording medium carrying an unfixed image is conveyed to the nip and the fixing device fixes the unfixed image onto the recording medium; and a shielding member disposed between the fixing belt and the heat generation part of the heat source and configured to shield heat from the heat source at least at an area outside the maximum passing area of the recording medium.

According to the optimal fixing device, by shielding the heat from the heat source by a shielding member, an excessive temperature rise of the fixing belt outside the maximum sheet passing area of the recording medium can be prevented and the fixing belt can be prevented from being degraded or damaged by the heat.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Figure 1:
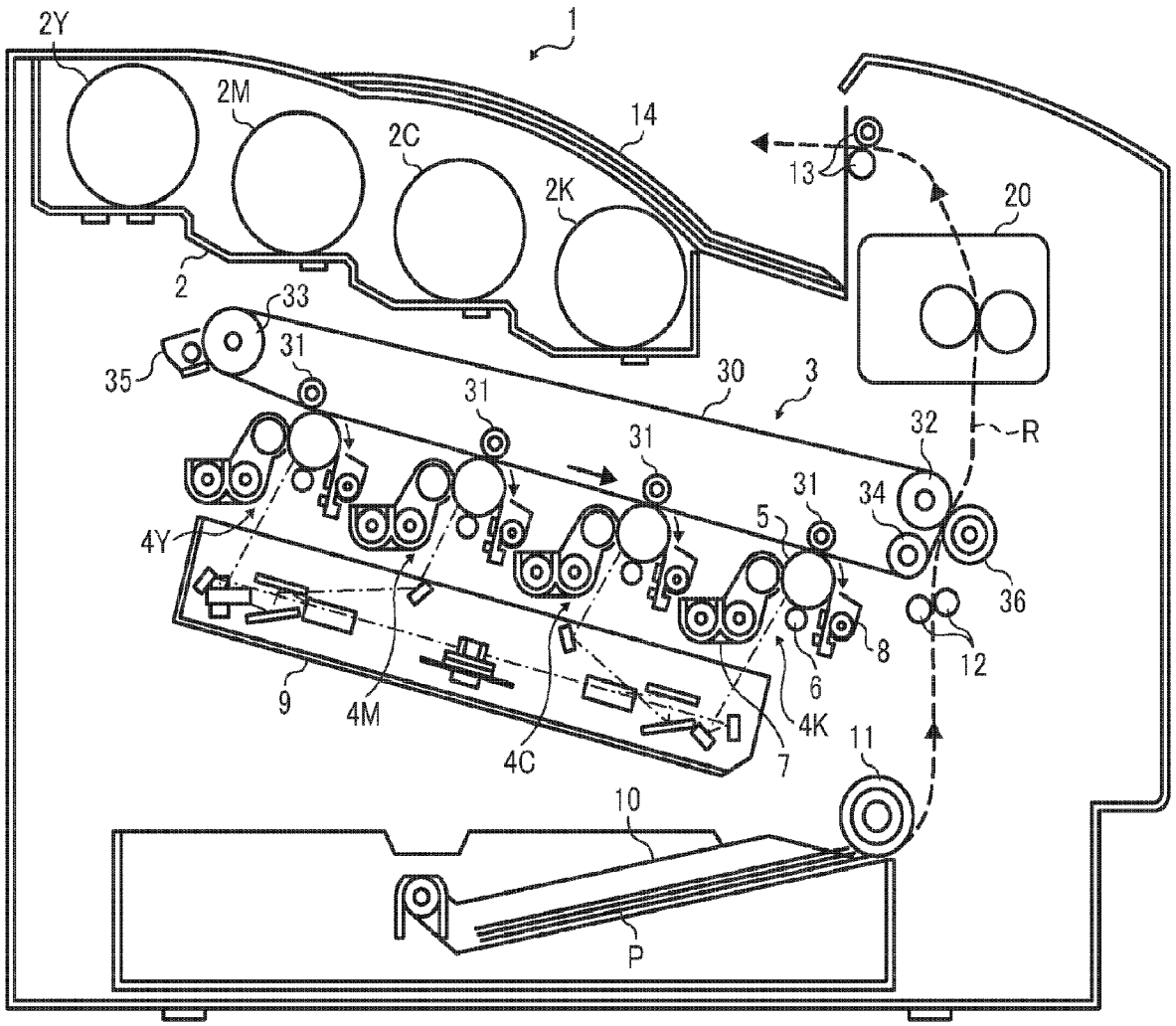
FIG. 1 shows a schematic view of an image forming apparatus according to an embodiment of the present invention.

Hereinafter, the present invention will now be described referring to the accompanying drawings. In each figure illustrating an embodiment of the present invention, a part or component having the same function or shape is assigned the same reference numeral, and once explained, a redundant description thereof will be omitted.

First, with reference to FIG. 1, an entire structure and operation of an image forming apparatus according to an embodiment of the present invention will be described.

As illustrated in FIG. 1, the image forming apparatus 1 is a color laser printer and includes four image forming units 4Y, 4M, 4C, and 4K in the center of the apparatus. Each of the image forming units 4Y, 4M, 4C, and 4K has the same structure except that each includes a different color of toner such as yellow (Y), magenta (M), cyan (C), and black (K) corresponding to RGB color separation components of a color image.

Specifically, each image forming units 4Y, 4M, 4C, and 4K includes a drum-shaped photoreceptor 5 as a latent image carrier; a charger 6 to charge a surface of the photoreceptor 5; a developing device 7 to supply toner on the surface of the photoreceptor 5; and a cleaning unit 8 to clean the surface of the photoreceptor 5. In FIG. 1, the photoreceptor 5, the charger 6, the developing device 7, and the cleaning unit 8 only are assigned reference numerals and reference numerals for other image forming units 4Y, 4M, and 4C are omitted.

An exposure unit 9 to expose the surface of the photoreceptor 5 is disposed underneath the image forming units 4Y, 4M, 4C, and 4K. The exposure unit 9 includes a light source, a polygonal mirror, an fθ lens, a reflection mirror, and the like, and is configured to emit laser beams onto each surface of the photoreceptor 5 based on image data.

A transfer device 3 is disposed above the image forming units 4Y, 4M, 4C, and 4K. The transfer device 3 includes an intermediate transfer belt 30 as a transfer member; four primary transfer rollers 31 as primary transfer means; a secondary transfer roller 36 as secondary transfer means; a secondary transfer backup roller 32; a cleaning backup roller 33; a tension roller 34; and a belt cleaning device 35.

The intermediate transfer belt 30 is an endless belt stretched around the secondary transfer backup roller 32, the cleaning backup roller 33, and the tension roller 34. When the secondary transfer backup roller 32 rotates, the intermediate transfer belt 30 is driven to rotate in the direction indicated by an arrow in the figure.

The four primary transfer rollers 31 each are disposed at a position opposed to each photoreceptor 5 with the intermediate transfer belt 30 sandwiched in between, thereby forming a primary transfer nip. In addition, each primary transfer roller 31 is connected with a power source, not shown, and a predetermined direct current (DC) voltage and/or alternating current (AC) voltage is applied to each primary transfer roller 31.

The secondary transfer roller 36 sandwiches the intermediate transfer belt 30 together with the secondary transfer backup roller 32 so as to form a secondary transfer nip. In addition, similarly to the primary transfer rollers 31, the secondary transfer roller 36 is connected with a power source, not shown, and a predetermined direct current (DC) voltage and/or alternating current (AC) voltage is applied to the secondary transfer roller 36.

The belt cleaning device 35 includes a cleaning brush and a cleaning blade which are so disposed as to contact the intermediate transfer belt 30. A hose for conveying waste toner, not shown, is extended from the belt cleaning device 35 and is connected with an inlet port of the waste toner container, not shown.

A bottle holder 2 is disposed at an upper part of the printer body. In the bottle holder 2, four toner bottles 2Y, 2M, 2C, and 2K each containing toner for replenishment are detachably mounted. A supply path, not shown, is disposed between each toner bottle 2Y, 2M, 2C, and 2K and each developing device 7. Toner is supplied to each developing device 7 from a corresponding toner bottle 2Y, 2M, 2C, or 2K.

A sheet feed tray 10 containing a sheet P as a recording medium and a sheet feed roller 11 to convey the sheet P from the sheet feed tray 10 are disposed at a bottom of the printer. Herein, in addition to regular sheets, the recording media include various sheets such as a cardboard, a postcard, an envelope, thin paper, coated paper or art paper, tracing paper, an OHP sheet, and the like. Although not illustrated in the figure, optionally a manual sheet feeder may be disposed to the subject printer.

Further, a conveyance path R through which the sheet P is conveyed from the sheet feed tray 10 to outside the printer via the secondary transfer nip is disposed inside the printer body. A registration roller pair 12 serving as a conveyance means to convey the sheet P to the secondary transfer nip is disposed in the conveyance path R upstream of the secondary transfer roller 36 in the sheet conveyance direction.

The fixing device 20 to fix an unfixed image transferred on the sheet P is disposed downstream in the sheet conveyance direction from the position of the secondary transfer roller 12. Further, a pair of sheet discharge rollers 13 to discharge the sheet is disposed downstream in the sheet conveyance direction of the conveyance path R from the fixing device 20. In addition, a sheet discharge tray 14 to stack the sheet discharged outside the printer is disposed above the printer body.

Next, with reference to FIG. 1, basic operation of the printer according to an embodiment of the present invention will be described.

When an image forming operation is started, each photoreceptor 5 of each of the image forming units 4Y, 4M, 4C, and 4K is driven by a driving device, not shown, to rotate clockwise as illustrated in FIG. 1, and each surface of the photoreceptor 2 is uniformly charged at a predetermined polarity by the charging device 6. An exposure unit 9 radiates laser beams to the charged surface of each photoreceptor 5 and an electrostatic latent image is formed on the surface of each photoreceptor 5. In this case, the image data exposed on each photoreceptor 5 is monochrome image data decomposed, from the target full-color image, into color data of yellow, magenta, cyan, and black. Each developing device 7 supplies toner to the electrostatic latent image formed on each photoreceptor 5, and the electrostatic latent image is rendered visible as a toner image.

When the image forming operation is started, the secondary transfer backup roller 32 rotates counterclockwise and the intermediate transfer belt 30 is driven to rotate in the direction indicated by an arrow in the figure. Then, a constant voltage or constant-current controlled voltage having an opposite polarity to the polarity of the charged toner is applied to each primary transfer roller 31. Accordingly, a transfer electric field is formed at a primary transfer nip between each primary transfer roller 31 and the counterpart photoreceptor 5.

Thereafter, upon the toner image of each color formed on the photoreceptor 5 reaching the primary transfer nip according to the rotation of each photoreceptor 5, the toner image of each color formed on each photoreceptor 5 is sequentially transferred in a superposed manner on the intermediate transfer belt 30 by the transfer electric field formed in the primary transfer nip. Thus, a full-color toner image is carried on the surface of the intermediate transfer belt 30. In addition, the residual toner which has not been transferred to the intermediate transfer belt 30 and remains on each photoreceptor 5 is removed by the cleaning unit 8. Thereafter, the surface of each photoreceptor 5 is subjected to a discharging operation by a discharger, not shown, and the surface potential is initialized.

The sheet feed roller 11 disposed in the bottom of the image forming apparatus is started to rotate so that the sheet P is sent out from the sheet feed tray 10 to the conveyance path R. The sheet P conveyed to the conveyance path R is sent to the secondary transfer nip between the secondary transfer roller 36 and the secondary transfer backup roller 32 driven in synch with the registration rollers 12. In this case, because the transfer voltage having a polarity opposite that of the charged toner of the toner image on the intermediate transfer belt 30 is applied to the secondary transfer roller 36, a transfer electric field is formed at the secondary transfer nip.

Thereafter, upon the toner image formed on the intermediate transfer belt 30 reaching the secondary transfer nip accompanied by the rotary run of the intermediate transfer belt 30, the toner image on the intermediate transfer belt 30 is transferred en bloc to the sheet P via the transfer electric field generated in the secondary transfer nip. In addition, the residual toner that has not been transferred to the intermediate transfer belt 30 and remains on the intermediate transfer belt 30 is removed by the belt cleaning unit 13 and is conveyed to and collected in a waste toner container, not shown.

Thereafter, the sheet P is conveyed to the fixing device 20 and the toner image on the sheet P is fixed onto the sheet P. The sheet P is then discharged outside the apparatus by the sheet discharge roller 13 and is stocked on the sheet discharge tray 14.

The explanation heretofore relates to an image forming operation when a full-color image is formed on the sheet; however, a monochrome image may be formed using any one of the four image forming units 4Y, 4M, 4C, and 4K and an image formed of two or three colors may be possible by using two or three image forming units.

Next, a description will be given of the construction of the fixing device 20 referring to FIG. 2.

Figure 2:
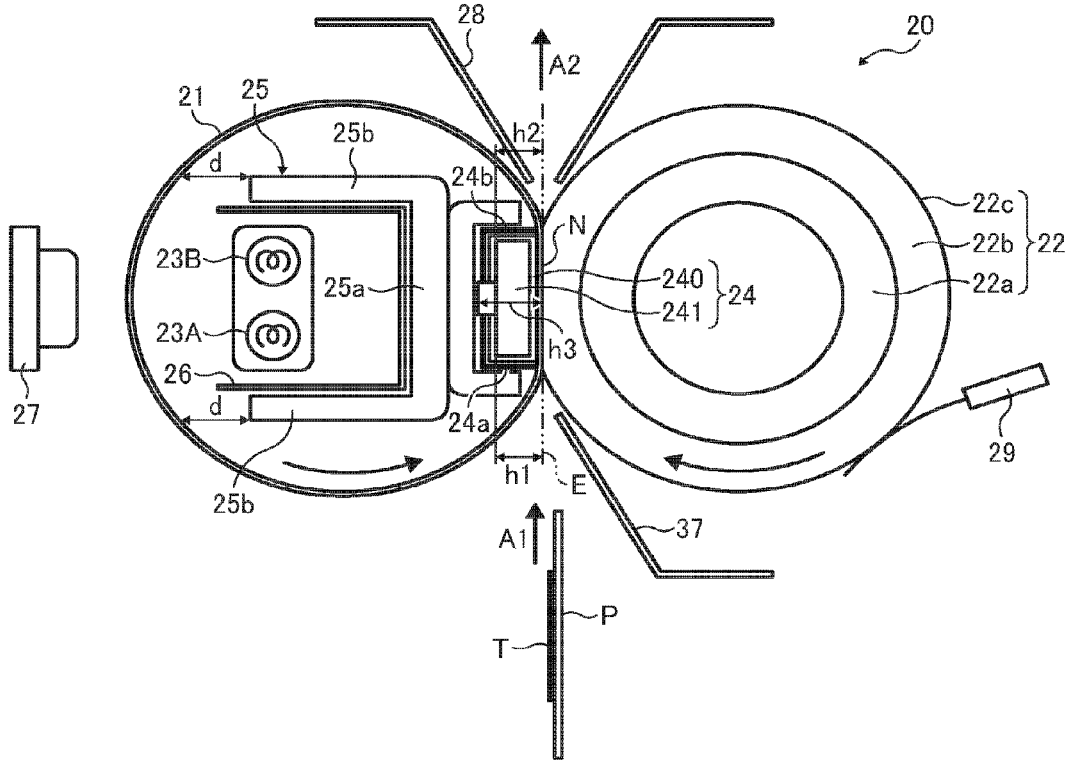
FIG. 2 is a schematic view of a fixing device included in the image forming apparatus of FIG. 1.

As illustrated in FIG. 2, the fixing device 20 includes a fixing belt 21 serving as a rotary member for fixation; a rotary pressure roller 22 disposed opposite the fixing belt 21; two halogen heaters 23A and 23B, heat sources to heat the fixing belt 21; a nip forming member 24 disposed in an interior of the fixing belt 21; a stay 25 to support the nip forming member 24; a reflecting member 26 to reflect the heat radiated from each of the halogen heaters 23A and 23B; a thermopile 27 as a temperature sensor detecting the temperature of the fixing belt 21; a thermistor 29 as a temperature sensor detecting the temperature of the pressure roller 22; a separator 28 to separate the sheet from the fixing belt 21; and a pressing member, not shown, to press the pressure roller 22 against the fixing belt 21.

The fixing belt 21 is formed of a thin, flexible endless belt material including a film. Specifically, the fixing belt 21 includes a base of an inner periphery side formed of metallic materials such as nickel or SUS or of resin materials such as polyimide (PI); and a release layer of an outer periphery side formed of copolymer of tetrafluoroethylene-perfluoroalkyl vinylether (PFA) or polytetrafluoroethylene (PTFE). In addition, an elastic layer formed of silicon rubber, foamable silicon rubber, or fluoro-rubber may be disposed between the base and the release layer.

The pressure roller 22 includes a metal core 22*a*; an elastic layer 22*b* formed on the metal core 22*a* formed of the foamable silicon rubber, the silicon rubber, or the fluoro-rubber; and the release layer 22*c* disposed on the surface of the elastic layer 22*b* and formed of PFA or PTFE. The pressure roller 22 is pressed toward the fixing belt 21 by a pressurizing member, not shown, and is contacted to the nip forming member 24 via the fixing belt 21. The elastic layer 22*b* of the pressure roller 22 is pressed and deformed at a portion where the pressure roller 22 and the fixing belt 21 are pressed against each other, thereby forming a nip N with a predetermined width. The pressure roller 22 is configured to rotate by a driving source such as a motor, not shown, disposed in the printer body. Further, when the pressure roller 22 is driven to rotate, the driving force of the pressure roller 22 is transmitted to the fixing belt 21 at the nip N, so that the fixing belt 21 is driven to rotate.

In the present embodiment, the pressure roller 22 is configured to be a hollow roller, but may be a solid-core roller instead. Further, a heat source such as a halogen heater may be disposed inside the pressure roller 22. If the pressure roller 22 does not include an elastic layer, the thermal capacity of the pressure roller 22 is reduced and fixability is improved. However, when the unfixed toner is pressed and fixed, minute concavity and convexity of the belt surface is transferred to the image and the solid image portion may include uneven glossiness. To prevent such uneven glossiness of the image, the elastic layer with a thickness of 100 μm or more is desired. The elastic layer with a thickness of 100 μm or more may absorb the minute concavity and convexity of the belt surface due to the elastic deformation of the elastic layer, thereby preventing the uneven glossiness from occurring. The elastic layer 22*b* may be formed of a solid rubber but may be a sponge rubber when the pressure roller 22 does not include a built-in heater. The sponge rubber is preferable because it increases heat insulating property and prevents the heat of the fixing belt 21 from being absorbed. The rotary fixing roller and the opposite pressure roller are configured to press against each other but may only be contacted and not pressed.

Both lateral ends of the halogen heaters 23A and 23B each are fixed to a side plate, not shown, of the fixing device 20. The output of each of the halogen heaters 23A and 23B is controlled by the heat source disposed in the printer body based on the detection result of the surface temperature of the fixing belt 21 by the thermopile 27. Such a controlled output of the halogen heaters 23A and 23B allows the temperature of the endless belt 21 to achieve a desired temperature. It is to be noted that the heat source to heat the fixing belt 21 may be a heat source other than the halogen heater used in the present embodiment.

The nip forming member 24 includes a base pad 241 and a friction sheet (a low-friction sheet) 240 disposed on the surface of the base pad 241. The base pad 241 is longitudinally disposed along the axis of the fixing belt 21 or the pressure roller 22 and defines a shape of the nip N while receiving the pressure from the pressure roller 22. Further, the base pad 241 is fixedly supported by the stay 25. With this structure, bending of the nip forming member 24 due to the pressure from the pressure roller 22 may be prevented from occurring and a uniform nip width may be obtained along the axis of the pressure roller 22. It is preferred that the stay 25 be formed of a metal material having a high mechanical strength such as stainless steel or iron so as to exert the bending prevention function. In addition, the base pad 241 is also preferably formed of a material having a certain stiffness to secure the strength. Examples of the materials for the base pad 241 include: resins such as liquid crystal polymer (LCP), metals, or ceramics.

Further, the base pad 241 is formed of heat-resistant materials with heat proof temperature against 200 degrees C. or more. With this structure, the deformation of the nip forming member 24 due to the heat may be prevented in the toner fixation temperature range, the stable state of the nip N is secured, and the output image quality is stabilized. Specifically, the base pad 241 may be formed of common heat-resistant resins such as polyethersulphone (PES), polyphenylene sulphide (PPS), liquid crystal polymer (LCP), polyether nitrile (PEN), polyamide imide (PAI), polyetheretherketone (PEEK), and the like.

The friction sheet 240 may only be disposed on the surface of the base pad 241 and opposite the fixing belt 21. Because the fixing belt 21 scrubs the low-friction sheet 240 while rotating, the driving torque exerted to the fixing belt 21 can be reduced, thereby reducing the load on the fixing belt 21 due to the friction force. Alternatively, the friction sheet can be eliminated.

The reflecting member 26 is disposed between the stay 25 and the halogen heaters 23A and 23B. Examples of materials for the reflecting member 26 include aluminum or stainless steel. By disposing the reflecting member 26, the heat radiated to the stay 25 from the halogen heaters 23A and 23B is reflected to the fixing belt 21. With this structure, the power of the heat radiated to the fixing belt 21 can be increased and the fixing belt 21 can be effectively heated. Further, because the radiation heat from the halogen heaters 23A and 23B transmitted to the stay 25 and the like can be minimized, energy saving may also be realized.

Furthermore, the fixing device 20 according to the present embodiment includes various structural artifices to further improve energy saving effects and reduce a first print output time.

Specifically, the fixing belt 21 can be directly heated by the halogen heaters 23A and 23B at portions other than the nip N (direct heating method). In the present embodiment, as illustrated in FIG. 2, there is no obstacle in the space inside the fixing belt 21 and between the fixing belt 21 and the halogen heaters 23A and 23B so that the radiation heat from the halogen heaters 23A and 23B is directly given to the fixing belt 21.

Further, the fixing belt 21 is thin and has a small diameter so as to realize a low thermal capacity. Specifically, each thickness of the base, the elastic layer, and the release layer is set respectively in a range from 20 to 50 μm, 100 to 300 μm, and 10 to 50 μm, and the total thickness is set within 1 mm. The diameter of the fixing belt 21 is set to 20 to 40 mm. To achieve a smaller thermal capacity, the total thickness of the fixing belt 21 is preferably less than 0.2 mm, and more preferably less than 0.16 mm. The diameter of the fixing belt 21 is preferably less than 30 mm.

In the preferred embodiment of the present invention, the diameter of the pressure roller 22 is set to 20 to 40 mm so that the diameters of both of the fixing belt 21 and the pressure roller 22 are identical. But the structure is not limited only to this. For example, it is possible to configure the fixing device such that the diameter of the fixing belt 21 is smaller than that of the pressure roller 22. In such a case, because the curvature radius of the fixing belt 21 in the nip N becomes smaller than that of the pressure roller 22, the recording medium discharged from the nip N is easily separated from the fixing belt 21.

As a result that the diameter of the fixing belt 21 is made smaller, the space inside the fixing belt 21 becomes smaller. In the present embodiment, the stay 25 is formed into a concave shape with both ends folded and the halogen heaters 23A and 23B are contained inside the folded concave-shaped portion. Thus, the stay 25 and the halogen heaters 23A and 23B may be disposed even in such a reduced space.

In addition, in order to dispose the maximum-sized stay 25 even inside the narrow space, the nip forming member 24 is formed into a compact size in reverse. Specifically, the width of the base pad 241 in the sheet conveyance direction is set smaller than that of the stay 25. As illustrated in FIG. 2, 24*a* denotes an upstream end of the base pad 241 and 24*b* denotes a downstream end of the base pad 241 in the sheet conveyance direction. h1 shows a height of the upstream end 24*a* from the nip N (or from a virtual extended line E) and h2 shows a height of the downstream end 24*b* from the nip N (or from the virtual extended line E). Further, h3 is a maximum height of the base pad 241 other than the upstream end 24*a* and the downstream end 24*b* from the nip N (or form the vertically extended line E). Between h1 to h3, h1</=h3 and h2</=h3. As configured as above, because the upstream end 24*a* and the downstream end 24*b* of the base pad 241 do not exist between both folded portions of the stay 25 upstream and downstream in the sheet conveyance direction and the fixing belt 21, each folded portion can be disposed in the vicinity of the inner peripheral surface of the fixing belt 21. Accordingly, the stay 25 can be maximally disposed within the limited space inside the fixing belt 21 to reinforce the stay 25. As a result, deformation of the nip forming member 24 due to the pressure roller 22 can be prevented and fixability can be improved.

To further reinforce the stay 25, the stay 25 includes a base part 25*a* and rising parts 25*b*. The base part 25*a* contacts the nip forming member 24 and extends in the sheet conveyance direction (i.e., in the vertical direction in FIG. 2). The rising parts 25*b* extend from upstream and downstream ends of the base part 25*a* toward a contacting direction with the pressure roller 22 (toward left in FIG. 2). Specifically, by disposing the rising parts 25*b* to the stay 25, the stay 25 has a laterally extending cross section in the pressurizing direction of the pressure roller 22, thereby increasing the section modulus. Accordingly, the mechanical strength of the stay 25 can be improved.

In addition, by lengthening the rising part 25*b* toward the contacting direction with the pressure roller 22, the strength of the stay 25 can be improved. Accordingly, the leading end of the rising part 25*b* is preferably as near as possible to the inner peripheral surface of the fixing belt 21. However, because the fixing belt 21 fluctuates to a greater or lesser extent, if the leading edge of the rising part 25*b* comes too near to the inner peripheral surface of the fixing belt 21, the fixing belt 21 may inadvertently contact the leading end of the rising part 25*b*. When using a thin fixing belt 21 as in the present embodiment, close attention is to be paid to the positioning of the leading end of the rising parts 25*b* because the fluctuation of the fixing belt 21 increases.

Specifically, a preferable distance d between the leading end of the rising parts 25*b* and the inner peripheral surface of the fixing belt 21 in the direction to contact the pressure roller 22 should be 2.0 mm, or more preferably 3.0 mm or more. On the other hand, if the fixing belt 21 includes a certain thickness and no fluctuation is observed, the distance d can be set to 0.02 mm.

Accordingly, by disposing the leading end of the rising parts 25*b* as near as possible to the inner peripheral surface of the fixing belt 21, the rising part 25*b* can be lengthened in the direction to contact the pressure roller 22. With this structure, even in the structure using the fixing belt 21 with a smaller diameter, the mechanical strength of the stay 25 can be increased.

Next, with reference to FIG. 2, a basic operation of the fixing device according to the present embodiment will be described.

When the power of the printer is turned on, electrical power is supplied to the halogen heaters 23A and 23B and the pressure roller 22 starts to rotate clockwise as illustrated in FIG. 2. Thus, the fixing belt 21 is driven to rotate counterclockwise by the pressure roller 22 as illustrated in FIG. 2.

Thereafter, an unfixed toner image T carried on the sheet P as described in the image forming process is conveyed while guided by a guide plate 37 in an arrow A1 direction in FIG. 2 and is sent into the nip N formed between the fixing belt 21 and the pressure roller 22 which are pressed against each other. Then, the toner image T is fixed onto the sheet P with heat from the fixing belt 21 heated by the halogen heaters 23A and 23B and pressure between the fixing belt 21 and the pressure roller 22.

The sheet P on which the toner image T is fixed is fed in the direction from the nip N to the direction of an arrow A2 in FIG. 2. At this time, the leading end of the sheet P contacts the leading end of the separator 28, whereby the sheet P is separated from the fixing belt 21. The thus separated sheet P is discharged outside the apparatus by the sheet discharge roller 13 and is stocked on the sheet discharge tray 14.

Next, the fixing device according to the present embodiment will be described in greater detail.

Figure 3:
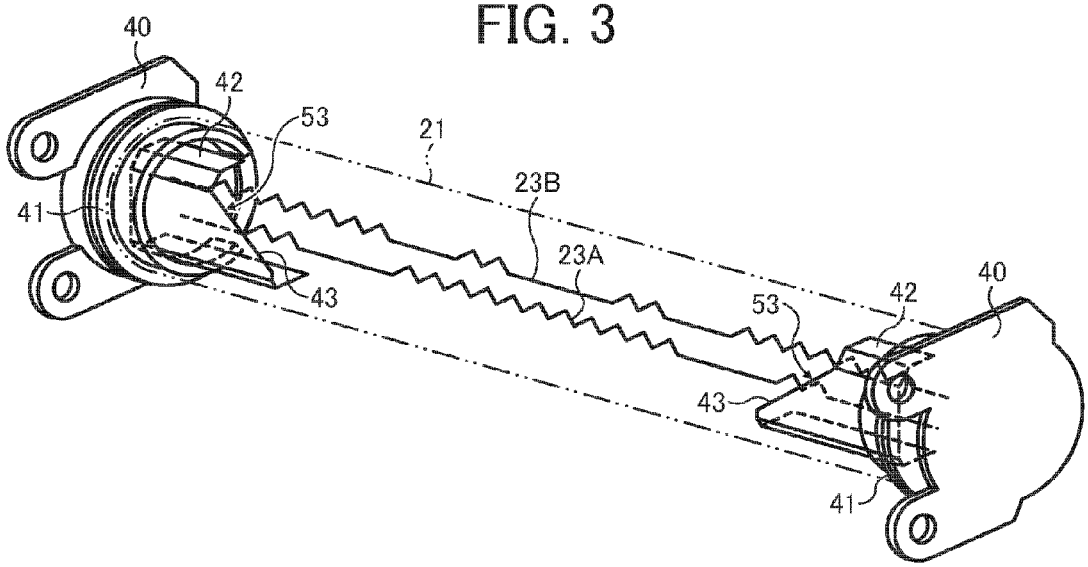
FIG. 3 is an oblique view of a shielding member disposed in the fixing device.

As illustrated in FIG. 3, a belt support member 40 is inserted to both lateral ends of the fixing belt 21. Each end of the fixing belt 21 is rotatably supported by the both belt support members 40. Each belt support member 40 is fixed to a side plate, not shown, of the fixing device. FIG. 3 does not show the nip forming member 24, the stay 25, the reflecting member 26, and the like unintentionally.

A slip ring 41 to protect the end portion of the fixing belt 21 is disposed between each end of the fixing belt 21 and the belt support member 40 opposing to the fixing belt 21. With this structure, the slip ring 41 prevents the end of the fixing belt 21 from directly contacting the belt support member 40 when the fixing belt 21 distorts in the axis direction, thereby preventing abrasion and damages of the end portion. In addition, the slip ring 41 is inserted to the belt support member 40 with a certain allowance with respect to the external periphery thereof. With this structure, when the end of the fixing belt 21 contacts the slip ring 41, the slip ring 41 may alternatively rotate accompanied by the rotation of the fixing belt 21 and may not rotate and remains still. As examples of materials for the slip ring 41, so-called super engineering plastics with a high thermal resistivity, for example, polyetheretherketone (PEEK), polyphenylene sulphide (PPS), polyamide imide (PAI), polytetrafluoroethylene (PTFE), and the like can be used.

Figure 4:
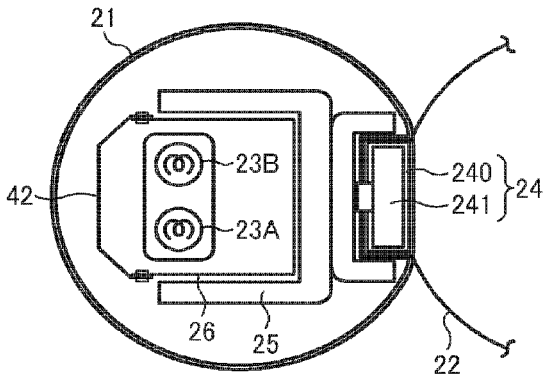
FIG. 4 is a cross-sectional view of a fixing device at a portion in which the shielding member is disposed.

In addition, a shielding member 42 to shield the fixing belt from heat from the halogen heaters 23A and 23B is disposed at both lateral ends of the fixing belt 21. Each shielding member 42 is disposed between the fixing belt 21 and the halogen heaters 23A and 23B. Further, a part of each shielding member 42 is inserted into the belt support member 40 and is disposed between the belt support member 40 and the halogen heaters 23A and 23B. As illustrated in FIG. 4, the shielding member 42 is disposed facing the halogen heaters 23A and 23B at a position opposite the position of the stay 25 and is fixed to the reflecting member 26.

Figure 5:
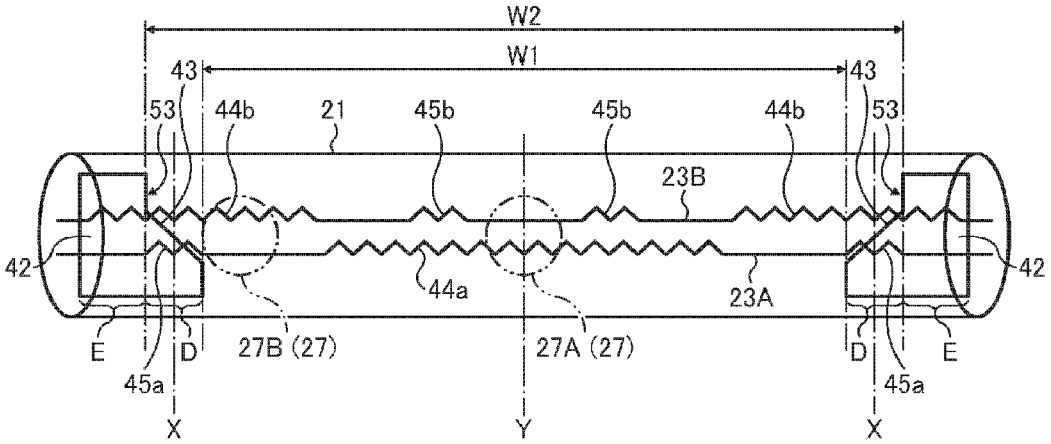
FIG. 5 is a view of the shielding member illustrating a disposed position thereof.

As illustrated in FIG. 5, if the lower halogen heater 23A is set to a first halogen heater and the upper halogen heater 23B is set to a second halogen heater for convenience, it is observed that each of the first and second halogen heaters 23A and 23B radiates heat at different positions from each other.

More specifically, the first halogen heater 23A includes a main heat-generation part 44*a* over a predetermined range from the center in the longitudinal direction and minute heat-generation parts 45*a* at both ends in the longitudinal direction. In the present embodiment, the main heat-generation part 44*a* is disposed within a range of 200 to 220 mm with the center part of the first halogen heater 23A set as a symmetrical axis, and the minute heat-generation parts 45*a* are disposed outside lateral ends of the above center part.

On the other hand, the second halogen heater 23B includes two minute heat-generation parts 45*b* in a central range of 200 to 220 mm with the center part of the second halogen heater 23B set as a symmetrical axis, and the main heat-generation parts 44*b* are disposed outside lateral ends of the center part contrary to the first halogen heater 23A. In addition, the outside edge of each main heat-generation parts 44*b* is located in a range of 300 to 330 mm from the central symmetrical axis.

Herein, the main heat-generation parts 44*a* and 44*b* of the first halogen heater 23A and the second halogen heater 23B are parts mainly radiating heat. In addition, each minute heat-generation part 45*a*, 45*b* is a support portion to support filaments of the halogen heater against the glass tube and generates heat in a sort of way. In the present embodiment, each minute heat-generation part 45*a*, 45*b* has a heat-radiation length of less than 5% of the whole length of the halogen heater.

In the present embodiment, there are two thermopiles 27 disposed to detect temperature of the fixing belt 21. As illustrated in FIG. 5, one thermopile 27A is disposed in the shaft center of the fixing belt 21 and another thermopile 27B is disposed at an end in the shaft direction of the fixing belt 21. The center thermopile 27A is disposed to detect a temperature of the part corresponding to the main heat-generation part 44*a* of the first halogen heater 23A. The end thermopile 27B is disposed to detect a temperature of the part corresponding to the main heat-generation parts 44*b* of the second halogen heater 23B.

As illustrated in FIG. 5, the area represented by a reference numeral W1 shows a sheet passing area when an A3-sized sheet is passed with its longer-side along the sheet conveyance direction or when an A4-sized sheet is passed with its shorter-side along the sheet conveyance direction. Further, the area represented by a reference numeral W2 shows a sheet passing area when a 12-inch-sized sheet is passed having a wider width than the shorter side of the A3-sized sheet or the longer side of the A4-sized sheet. Specifically, the width of the sheet passing area W1 corresponding to the shorter side of the A3 sheet and the longer side of the A4 sheet is 297 mm with the center of the fixing belt 21 as a symmetrical center and the width of the sheet passing area W2 for the 12-inch sheet is 304.8 mm with the center of the fixing belt 21 as a symmetrical center.

The above shielding member 42 is disposed at an outer side than the sheet passing area W1 for the shorter side of the A3 sheet or the longer side of the A4 sheet. More specifically, each shielding member 42 is disposed over the outer side than the heat generation part (that is, the main heat-generation parts 44*b* of the second halogen heater 23B) disposed at the outermost position from the outer end of the sheet passing area W1 for the shorter side of the A3 sheet or the longer side of the A4 sheet.

Further, the shielding member 42 is formed with a notch 53 at a portion D disposed at an inner side than the sheet passing area W2 for the 12-inch sheet. The notch 53 is a portion notched from the end to the center of the fixing belt 21. When the notch 53 is disposed at a part of the shielding member 42, the area of the shielding member 42 opposed to the interior surface of the fixing belt 21 is reduced than the portion E without the notch 53. The portion E is an area disposed at an outer side than the sheet passing area W2 for the 12-inch sheet. Specifically, the portion D where the notch 53 is disposed has a less heat-shielded area against the heat from the halogen heaters 23A and 23B compared to the portion E where the notch 53 is not disposed.

Figure 6:
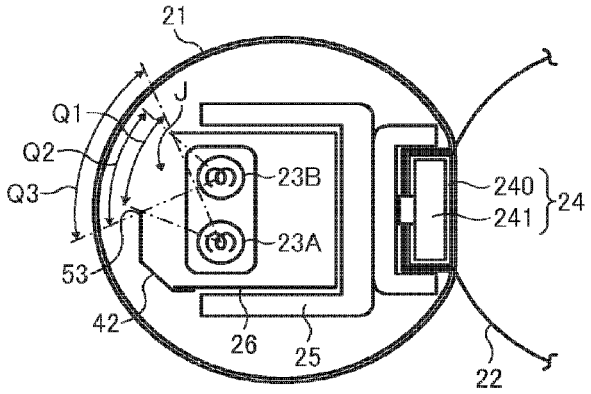
FIG. 6 is a cross-sectional view of a fixing device at a portion in which a notch is provided to the shielding member.

In the present embodiment, the halogen heaters 23A and 23B are covered by the shielding member 42 and the reflecting member 26 over an entire portion in the portion E where the notch 53 is not disposed as illustrated in FIG. 4, but a portion J is open by the notch 53 in the portion D where the notch 53 is disposed as illustrated in FIG. 6. Accordingly, the heat from the halogen heaters 23A and 23B is radiated to the fixing belt 21 at the portion D where the notch 53 is disposed.

In addition, the notch 53 includes a slant 43 slanted toward the shaft direction of the fixing belt 21. As illustrated in FIG. 5, the slant 43 is slanted downwards in the figure toward the sheet passing area W1 for the shorter side of the A3 sheet or the longer side of the A4 sheet. Specifically, the area of the shielding member 42 opposed to the internal peripheral surface of the fixing belt 21 is gradually reducing toward the sheet passing area W1 for the shorter side of the A3 sheet or the longer side of the A4 sheet. In the present embodiment, the slant 43 is formed to have a linear shape but may be formed to be a curved or other shape.

Herein, FIG. 6 is a cross-sectional view in the peripheral direction of the fixing belt 21 taken at the notch 53, in which the area of the heat directly radiated (without intermediary of the reflecting member 26 and the like) from the irradiation center of the halogen heaters 23A and 23B toward the fixing belt 21 is defined as a direct radiation area. Because two pieces of halogen heaters are disposed in the present embodiment, the direct radiation area is a range Q3 including the direct radiation areas of Q1 and Q2 by each of the halogen heaters 23A and 23B. In addition, because the notch 53 includes a slant 43, the direct radiation area varies according to the slanted degree of the slant 43. In this case, the direct radiation area Q3 gradually increases toward the center of the fixing belt 21 and the heat amount radiated to the fixing belt 21 increases.

Hereinafter, the function and effect of the shielding member 42 when the various-sized sheets are printed will now be described.

First, when the A3-sized sheet is printed with its longer-side along the sheet conveyance direction or the A4-sized sheet is printed with its shorter-side along the sheet conveyance direction, both the first halogen heater 23A and the second halogen heater 23B are caused to perform radiation. The heat radiation length is set at the range of 300 to 330 mm which is longer than the sheet passing width (297 mm) of the shorter side of the A3 sheet and the longer side of the A4 sheet. However, because the heat source such as a halogen heater has a characteristic in which a heat power is reduced at an end portion thereof, if the heat length is set at the same area as the sheet passing area, the heat distribution in the edge portion of the sheet passing area when the warm-up is completed or when the printing is started becomes lower than the center portion. Accordingly, the heat-emission length of the halogen heater is set to be longer than the sheet passing width of the regular size sheet so that the area with a constant heat power is coincident with the sheet passing area, and thus, fixability at an edge portion even in the first print can be secured.

However, in general, if the heat emitting part is disposed toward outside of the sheet passing area W1, when the A3 sheet or A4 sheet is continuously printed, even though the heat amount in the extended portion of the heater is small at an outside the sheet passing area W1, the temperature of the fixing belt is increased excessively and exceeds the endurable range for the fixing belt 21 because the heat of the fixing belt 21 is not absorbed by the sheet. Therefore, in the present embodiment, by disposing the shielding member 42 at the outside the sheet passing area W1 for the A3 sheet or the A4 sheet, the heat radiated to the shielding member 42 from the halogen heaters 23A and 23B is shielded. With such a structure, securing fixability at the edge portion even in the first print, the excessive heat rise of the fixing belt 21 at an outside of the sheet passing area W1 when the A3-sized sheets or the A4-sized sheets are continuously printed can be prevented.

The shielding against the heat by the shielding member according to the present embodiment is performed by shielding the heat from the heat source completely by the shielding member; however the shielding may be realized by the material or the structure of the shielding member having a property to partially permeate the heat and partially shielding it. In addition, the surface of the shielding member 42 opposed to the halogen heaters 23A and 23B can be subjected to mirror-like finishing or can be provided with a reflecting member as a reflection surface. In this case, because the reflection surface can reflect the heat from the halogen heaters 23A and 23B, the excessive temperature rise of the shielding member 42 itself can be prevented as well as the heat transmission to parts around the shielding member 42 can be reduced.

In addition, because the halogen heaters 23A and 23B include minute heat-generation parts 45*a* and 45*b* to support filaments of the halogen heaters against the glass tube, heat from these minute heat-generation parts 45*a* and 45*b* may cause varied heat distribution or an excessive heat rise. Therefore, in the present embodiment, by disposing the shielding member 42 between the minute heat-generation parts 45*a* at the end of the first halogen heater 23A and the fixing belt 21 as illustrated in FIG. 5, the heat from the minute heat-generation part 45*a* is shielded by the shielding member 42, thereby restricting or preventing the occurrence of the above disadvantage.

Figure 7:
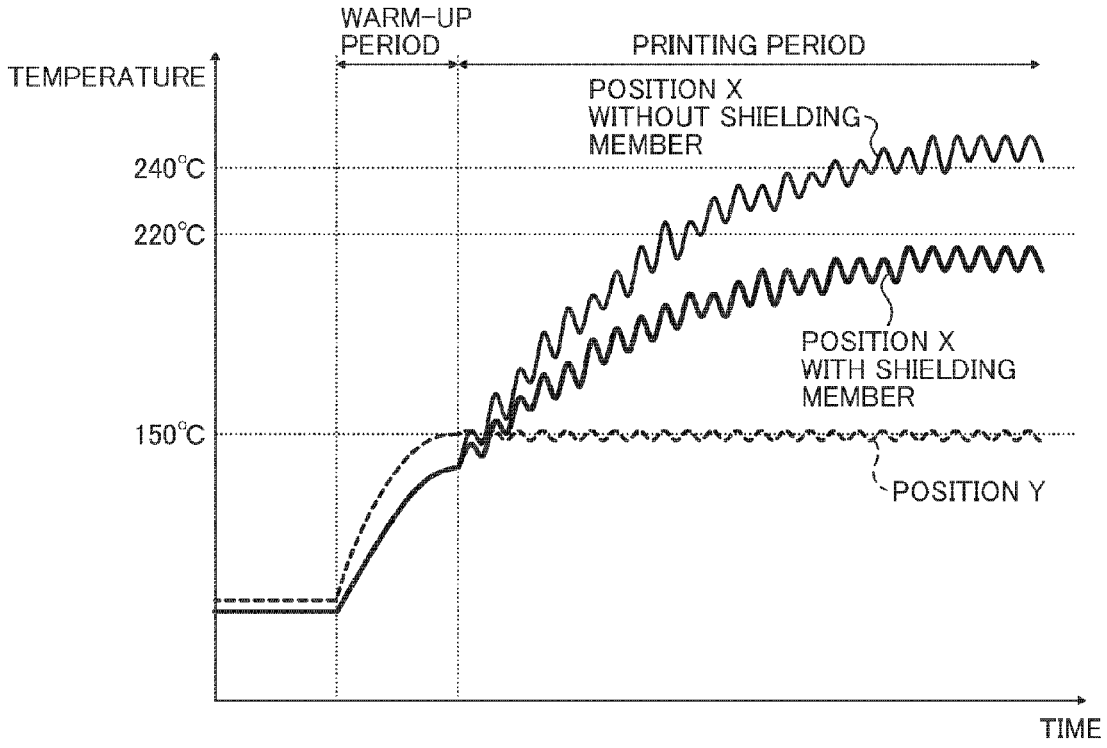
FIG. 7 is a graph illustrating a temperature change of a fixing belt for a comparison between cases with and without the shielding member.

FIG. 7 is a graph illustrating a temperature change of a fixing belt for a comparison between cases with and without the shielding member.

A bold line in FIG. 7 shows temperature changes at a position X at the end of the belt of FIG. 5 when the shielding member is disposed, and a thin line in the same figure shows temperature changes at the position X at the end of the belt when the shielding member is not used. Further, a dotted line shows temperature changes at the belt center position Y in FIG. 5.

As illustrated in FIG. 7, the bold line in which a shielding member is used shows that the temperature rise of the fixing belt outside the sheet passing area of the shorter side of the A3 sheet or the longer side of the A4 sheet can be suppressed well compared to the thin line in FIG. 7 without using the shielding member. As observed in the figure, when the shielding member is not used, the temperature of the fixing belt exceeds the heatproof temperature of the fixing belt, i.e., 220 degrees C. By contrast, when the shielding member is used, the temperature of the fixing belt can be suppressed below the heatproof temperature of 220 degrees C.

Next, a case in which the 12-inch sheet is printed will be described. When the 12-inch sheet is printed, the both halogen heaters 23A and 23B are radiated similarly to the case of printing the A3-sized sheet or the A4-sized sheet. In this case, as illustrated in FIG. 5, because the shielding member 42 partly overlaps with an end portion of the 12-inch sheet (that is, a range represented by the alphabetical code D in FIG. 5), the heat from the halogen heaters 23A and 23B is shielded at the overlapped portion. As a result, when heating is not enough at the end portion of the fixing belt, defective fixation may occur at the edge of the sheet.

Accordingly, by forming a notch 53 at the above overlapped portion (that is, the portion D in FIG. 5), an opening is provided at a part in the belt circumferential direction, so that the heat can be radiated to the fixing belt 21. Specifically, because the notch 53 is disposed in the portion D, the area of the shielding member 42 opposed to the inner periphery of the fixing belt 21 is reduced than the portion E, thereby increasing the thermal capacity or the heat amount given to the fixing belt 21.

Figures 8A, 8B:
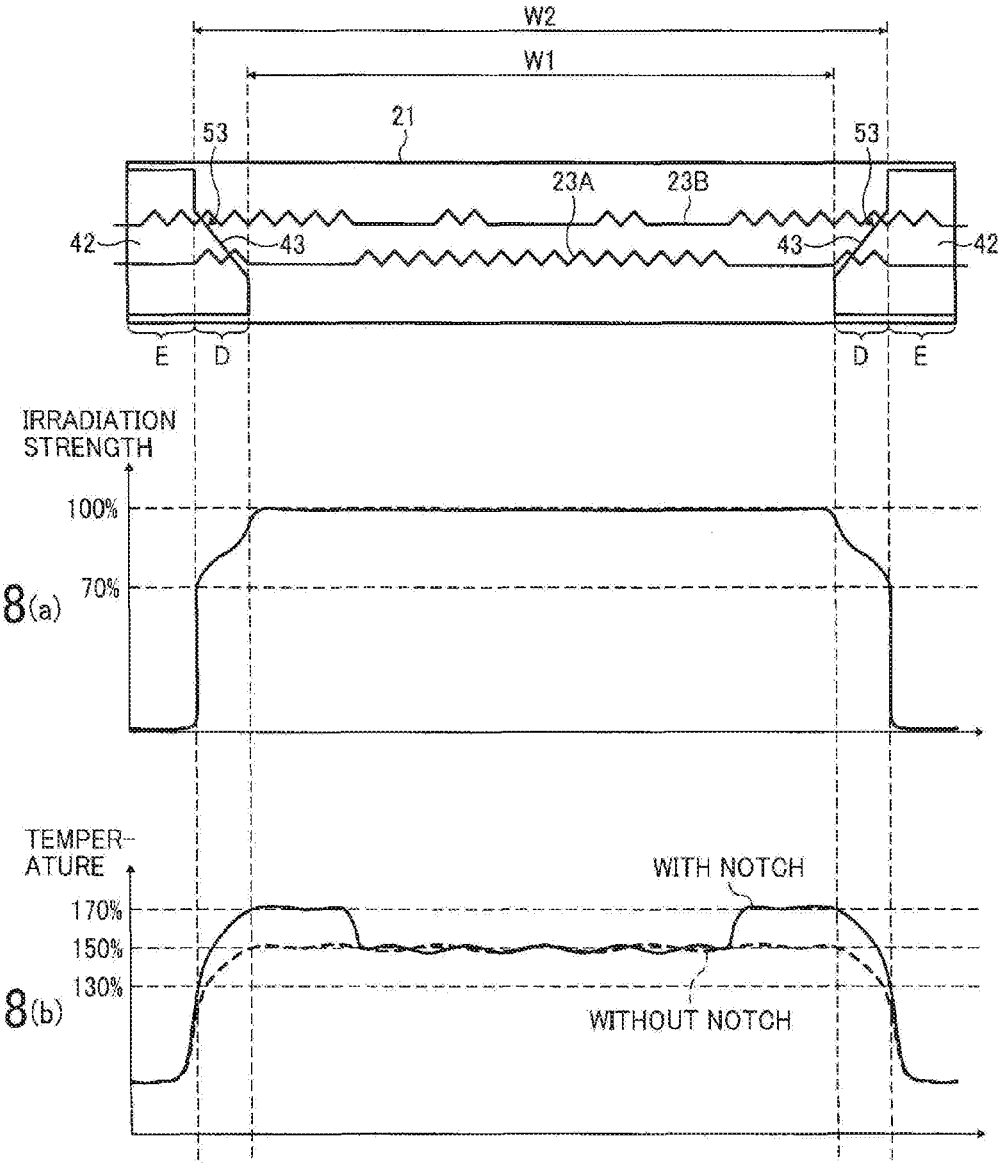
FIG. 8(*a*) shows a distribution of relative heat radiation strength along the axis of the fixing belt and FIG. 8(*b*) shows a distribution of temperature in the axial direction of the fixing belt.

FIG. 8(*a*) shows a distribution of relative heat radiation strength along the axis of the fixing belt.

As illustrated in FIG. 8(*a*), the portion D where the notch 53 is disposed receives a high heat radiation strength compared to the portion E where the notch 53 is not disposed. This is because the portion D where the notch 53 is disposed receives more heat radiated to the fixing belt 21 through the opening.

FIG. 8(*b*) shows a distribution of temperature in the axial direction of the fixing belt.

The solid line in FIG. 8(*b*) shows a temperature distribution when the part of the shielding member includes a notch 53 as in the present embodiment and the dotted line in FIG. 8(*b*) shows a temperature distribution when the notch 53 is not disposed and the heat is shielded by the shielding member 42 over an entire periphery in the belt circumferential direction.

As described in FIG. 8(*b*), when the notch 53 is not disposed as in dotted line, because enough irradiation strength is not obtained in the portion D corresponding to the disposed position of the notch 53, the temperature of the fixing belt 21 is decreased. Due to this, if the notch is not formed, it could lead to defective fixation at both ends of the sheet passing area W2 for the 12-inch sheet.

By contrast, if there is provided a notch as observed by the solid line in FIG. 8(*b*), because the heat is radiated through the opening, the temperature at the ends of the fixing belt 21 can be raised compared to the case in which the notch is not formed. Accordingly, the sufficient heat is given to both ends of the sheet passing area W2 for the 12-inch sheet, thereby restricting or preventing occurrence of defective fixation.

As described above, in the present embodiment, because the notch 53 is disposed at a part of the shielding member 42, a certain degree of irradiation strength can be obtained at both ends of the 12-inch sheet, but the irradiation strength at the portion D where the notch 53 is disposed may not be uniform. This is because the edge portion of the sheet has a low possibility to carry an unfixed image, the irradiation strength or the thermal capacity at the edge portion need not be so large. Accordingly, in the present embodiment, by disposing a slant 43 to the portion D where the notch 53 is disposed, the irradiation strength is set to be gradually reduced toward the ends of the fixing belt 21 or the ends of the sheet as illustrated in FIG. 8(*a*).

Figure 9A:
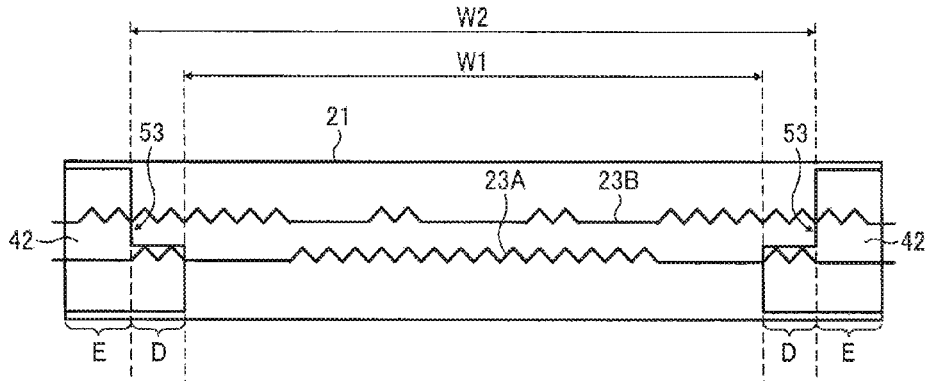
FIGS. 9(*a*) to 9(*c*) are views illustrating a modified example of the shielding member.
Figure 9B:
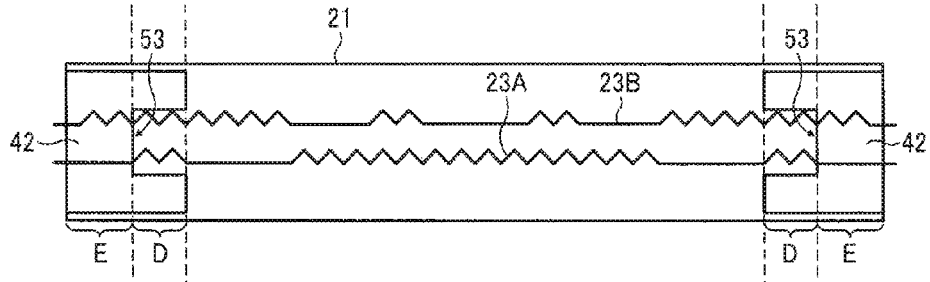
Figure 9C:
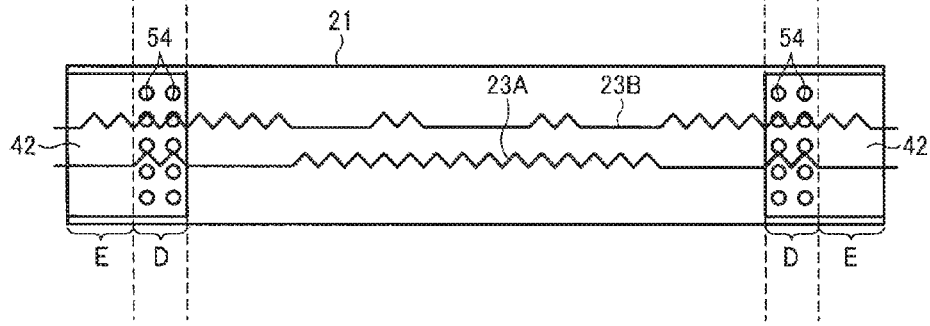

FIGS. 9(*a*) to 9(*c*) are views each illustrating a modified example of the shielding member.

In the modified examples as illustrated in FIGS. 9(*a*) to 9(*c*), a notch 53 is formed at a portion D of the shielding member 42 similarly to the above embodiment. However, the notch 53 herein does not include a slant 43. As such, without forming a slant 43 in the notch 53, the edge of the notch 53 may be formed in parallel with the shaft direction of the fixing belt 21. Accordingly, the sufficient heat is given to both ends of the sheet passing area W2 for the 12-inch sheet, thereby restricting or preventing occurrence of defective fixation. In this case also, if the heat can be radiated to the fixing belt 21 through the opening formed by the notch 53, the heat reduction at both ends of the sheet passing area W2 for the 12-inch sheet can be prevented.

Further, FIG. 9(*c*) shows a modified example in which the portion D of the shielding member 42 includes a plurality of through-holes 54. In this case, heat can be radiated to the fixing belt 21 through the through-holes 54 and the heat reduction at both ends of the sheet passing area W2 for the 12-inch sheet can be prevented.

In the present embodiment, the temperature required for the fixation of a monochrome image is 130 degrees C. or more and 140 degrees C. or more for a full-color image. When the 12-inch sheet is printed, if the printing is performed with the fixation condition for the A3 sheet or the A4 sheet, there is a possibility that not enough thermal capacity is obtained at both ends of the 12-inch sheet.

Therefore, in the present embodiment, the fixation condition is controlled as follows.

Figure 10A:
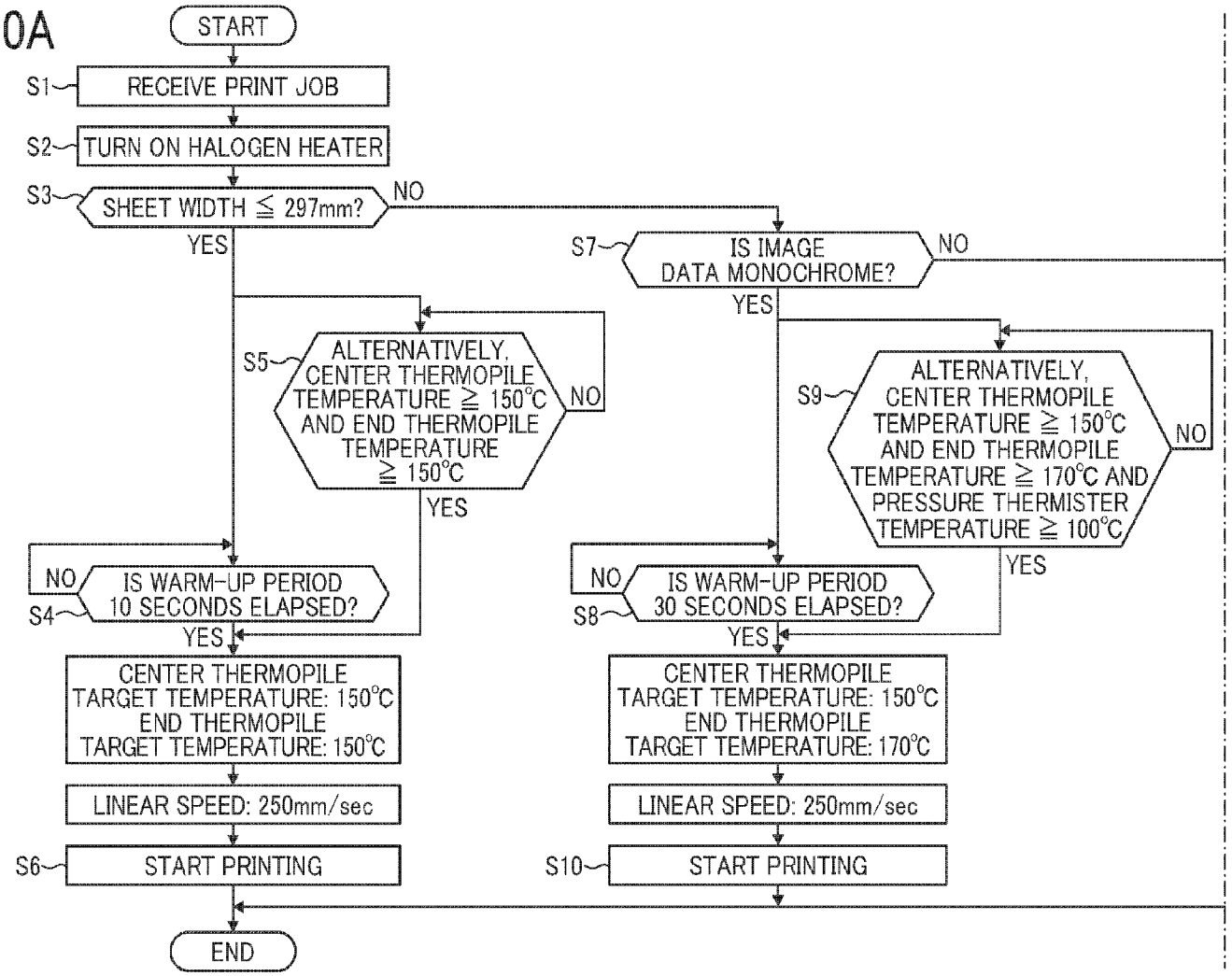
FIGS. 10A to 10B is a flowchart illustrating control of the fixing operation.
Figure 10B:
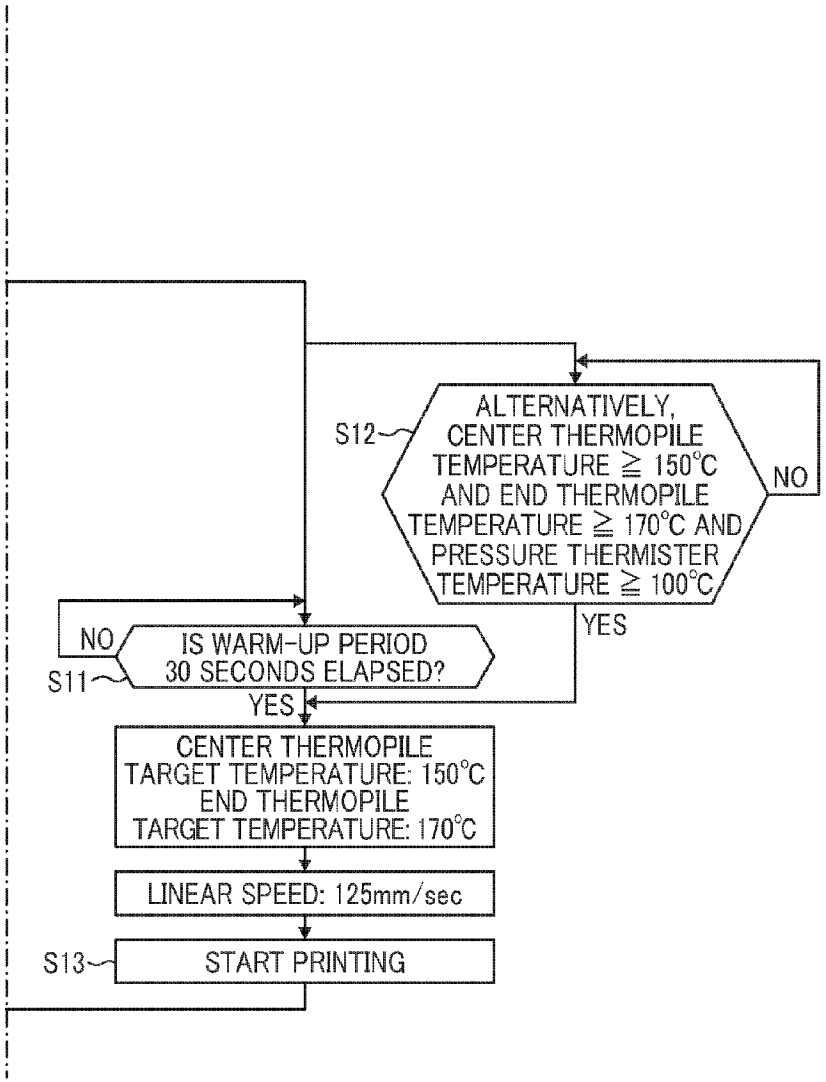

FIGS. 10A to 10B is a flowchart illustrating a control of the fixing operation. As FIGS. 10A to 10B shows, when a print job is received (in step S1), a warm-up operation is started and each halogen heater is lit (S2). Then, based on the print job data, whether or not the width of the supplied sheet for printing is less than 297 mm (S3) is determined.

As a result, if the required sheet width is equal to or less than 297 mm, that is, the shorter side of the A3-sized sheet or the longer side of the A4-sized sheet being 297 mm, when the warm-up time (heating time of the fixing belt) of 10 seconds has been elapsed (S4), or alternatively when the both temperatures detected by the thermopile in the center and the thermopile at the end have reached 150 degrees C. (S5), an image forming operation is started and the sheet feeding is started (S6). In this case, the target temperature for the fixing belt during the printing operation is controlled so that temperatures detected by the center thermopile and the end thermopile both remain 150 degrees C. and that the linear conveyance speed of the sheet is set at 250 mm/sec.

On the other hand, when the sheet passing width is larger than 297 mm, for example, 304.8 mm of the 12-inch sheet, a further determination on whether or not the monochrome image or color image is to be printed is performed based on the print job data.

As a result, if the to-be-printed image is a monochrome image, when the warm-up time of 30 seconds has elapsed (S8), or alternatively when the temperature detected by the center thermopile is 150 degrees C., the temperature detected by the end thermopile is 170 degrees C., and the temperature detected by the thermistor disposed at the pressure roller is 100 degrees C. (S9), an image forming operation is started and sheet feeding is started (S10). In this case, because the warm-up time lengthened or the temperature detected by the end thermopile is set higher compared to a case in which the passing sheet width is equal to or less than 297 mm, fixing temperature at both ends of the 12-inch sheet can be increased and an optimal fixability can be obtained. Further in this case, the target temperature detected by the center thermopile and the linear speed of the conveyed sheet during the printing, are set to 150 degrees C. and 250 mm/sec, respectively.

If as a result of determination on whether the to-be-printed image is a monochrome image, the to-be-printed image is a color image similarly to the case of the monochrome image, when the warm-up time of 30 seconds has elapsed (S11), or alternatively when the temperature detected by the center thermopile is 150 degrees C., the temperature detected by the end thermopile is 170 degrees C., and the temperature detected by the thermistor disposed at the pressure roller is 100 degrees C. (S12), an image forming operation is started and sheet feeding is started (S13). Accordingly, the fixing temperature at both ends of the 12-inch sheet can be increased. Further, in the case of printing a color image, the linear speed of the sheet is reduced to half the linear speed for the monochrome image, that is, to 125 mm/sec. Accordingly, even when printing an image with a high toner deposition amount, an optimal fixability can be obtained.

Thus, when a 12-inch sheet is to be printed, the image fixation condition is changed from the case in which the A3-sized sheet or the A4-sized sheet is printed, thereby securing enough thermal capacity required for the fixation and obtaining an optimal printed image. The selection of any from the three fixation conditions of the warm-up time, target temperature at the end of the fixing belt, and the linear speed of the to-be-fed sheet may be arbitrary performed depending on the properties of the fixing device. Any one or ones of the fixation conditions can be selected.

Figure 11:
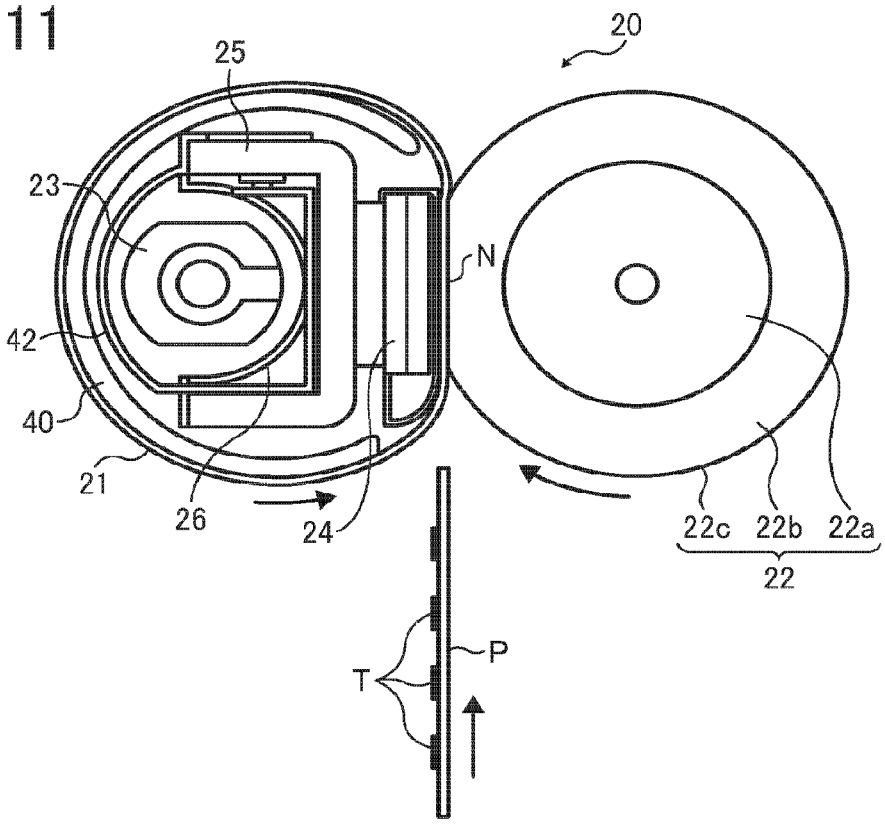
FIG. 11 is a view illustrating another fixing device employing the structure of the present invention.
Figure 12:
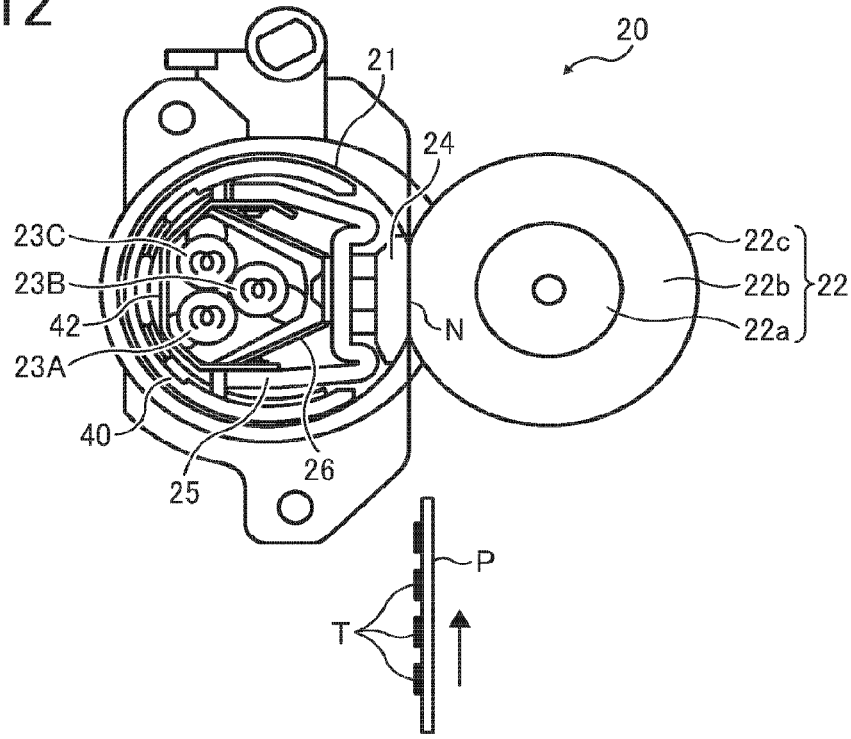
FIG. 12 is a view illustrating yet another fixing device employing the structure of the present invention.
Figure 13:
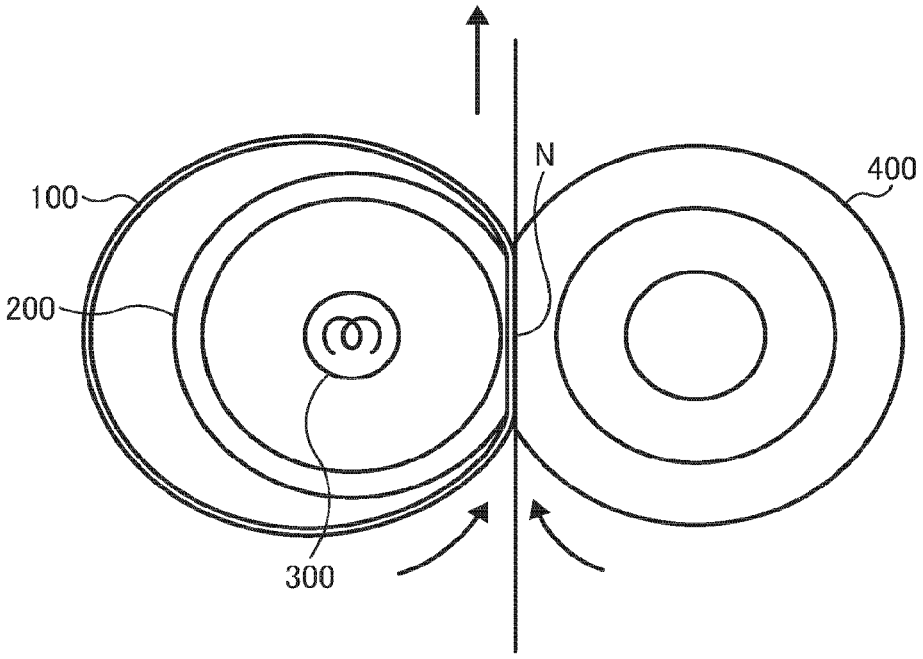
FIG. 13 BACKGROUND ART
FIG. 13 is a general configuration of a first conventional fixing device.
Figure 14:
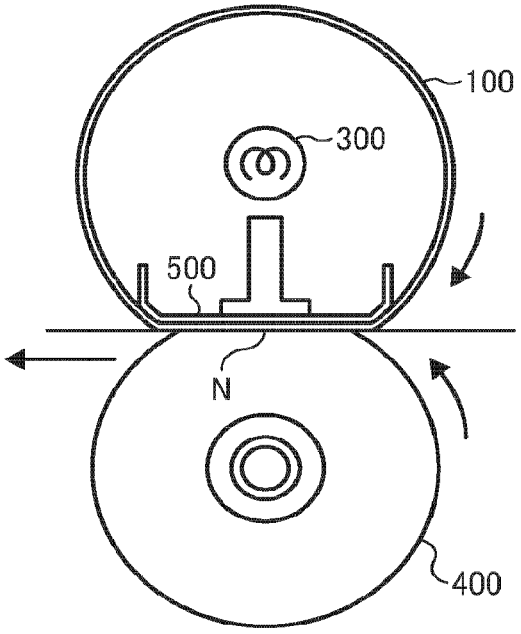
FIG. 14 BACKGROUND ART
FIG. 14 is a general configuration of a second conventional fixing device.

FIGS. 11 and 12 are views illustrating the structure of the fixing device to which the present embodiment of the present invention is applied.

The fixing device as illustrated in FIG. 11 includes a halogen heater 23 and the one as illustrated in FIG. 12 includes three halogen heaters 23A, 23B, and 23C. Without regard to the number of halogen heaters, the shielding member 42 can be disposed similarly to the embodiment described heretofore. The structure in FIGS. 11 and 12 other than the number of halogen heaters is basically identical to the above embodiment, and therefore further explanation will be omitted.

According to the present invention, even if the heat source includes a heating portion outside the maximum sheet passing area, unnecessary heating of the fixing belt in the non-sheet passing area can be prevented by disposing a shielding member 42 at least outside the maximum sheet passing area. With this structure, an excessive temperature rise of the fixing belt in the non-sheet passing area can be prevented.

Herein, the maximum sheet passing area denotes a largest sheet passing area if there is a plurality of sheet passing areas. However, as to the apparatus including only one sheet passing area, the one sheet passing area corresponds to the maximum sheet passing area. In addition, the plurality of sheet passing areas includes a plurality of sheet passing areas due to the difference of the A3-sized sheet and the A4-sized sheet, and further includes a plurality of sheet passing areas caused by printing, for example, the same A4-sized sheet with the longer side aligned along the sheet conveyance direction or with the shorter side aligned along the sheet conveyance direction.

According to the present invention, because an excessive temperature rise of the fixing belt in the non-sheet passing area can be minimized, the heating temperature of the fixing belt can be suppressed to below the heatproof temperature and the fixing belt can be prevented from being degraded or damaged by the heat. In particular, as described in the above embodiment, the fixing belt is formed into a thin layer and the temperature of the fixing belt tends to be increased easily. If the present embodiment is applied to the fixing device using such a fixing belt, an optimal effect is expected.

In the above-described embodiment of the present invention, the shielding member 42 includes a notch 53. Therefore, if a part of the shielding member 42 overlaps with the end of the sheet passing area, sufficient thermal capacity can be supplied to the sheet at both ends of the sheet passing area, thereby enabling to prevent the defective fixation from occurring.

The notch 53 further includes a slanted portion 43. With this structure, heat radiation amount is gradually reduced toward the sheet end portion where there is a high possibility that the unfixed image is carried and the unnecessary heating of the fixing belt can be optimally prevented. Accordingly, the degradation of and damage to the fixing belt due to heat can be reliably prevented. On the other hand, the heat radiation amount increases toward the sheet central portion where there is a high possibility that the unfixed image is carried. Thus, the thermal capacity necessary to the fixation can be securely obtained and an optimal image can be obtained.

The above description is of an image forming apparatus using mainly A3-size and A4-size sheets (297 mm) and 12-inch sheet (304.8 mm). However, the present invention may be applied to other types of image forming apparatuses using A4-size and letter-size sheets with the shorter side aligned along the sheet conveyance direction; i.e., 210 mm and 215.9 mm, respectively.

In the fixing device as described in the present embodiment, a page centering method in which the various sized sheets are centered in the fixing-belt axis direction is applied. However, alternatively, the structure disclosed in the present invention may be applied to a fixing device employing an end alignment method in which the end of the sheet width direction is aligned at the end of the fixing-belt axis direction and the sheet is conveyed.

The fixing device according to the embodiments of the present invention may be applied without limitation to a color laser printer, a monochrome image forming apparatus, or any other type of printer, facsimile machine, copier, or a multifunction apparatus combining the functions of the above devices.

Additional modifications and variations of the present invention are possible in light of the above teachings. It is therefore to be understood that, within the scope of the appended claims, the invention may be practiced other than as specifically described herein.

What is claimed is:

1. A fixing device comprising:

a rotary endless fixing belt;

a nip forming member disposed in an interior of the fixing belt;

a rotary opposed member disposed to contact the nip fainting member via the fixing belt to form a nip together with the fixing belt;

a heat source to heat the fixing belt directly at a portion other than the nip, the heat source including a heat generating portion disposed outside a maximum passing area of a recording medium passing through the nip;

a reflector to reflect heat or light radiated from the heat source;

a belt support member to rotatably support both lateral ends of the fixing belt; and a shield that shields the heat or light radiated from the heat source, the shield being fixedly disposed between the fixing belt and the heat generating portion of the heat source and between the belt support member and the heat source at least outside the maximum passing area of the recording medium, the shield being inserted inside the belt support member and fixedly disposed between the belt support member and the heat source at a position opposite the nip via the heat source.

2. The fixing device according to claim 1, wherein the shield is provided in and outside the maximum passing area of the recording medium.

3. The fixing device according to claim 1, wherein the reflector fixedly supports the shield to reflect the heat or light radiated from the heat source.

4. The fixing device according to claim 1, wherein the shield includes a notch notched from an end to a center of the fixing belt in a shaft direction of the fixing belt.

5. The fixing device according to claim 4, wherein the notch is provided in the maximum passing area of the recording medium and outside a narrower passing area narrower than the maximum passing area.

6. The fixing device according to claim 5, wherein the notch includes a slant slanted relative to the shaft direction of the fixing belt to gradually reduce a direct heated area of the fixing belt directly heated by the heat source toward the center of the fixing belt in the shaft direction of the fixing belt.

7. The fixing device, according to claim 1, wherein the belt support member is fixed to a side plate.

8. The fixing device according to claim 1, further comprising a support that supports the nip forming member and fixedly supports the shield.

9. The fixing device according to claim 8, wherein at least a part of the shield is disposed at a position opposite the support via the heat source.

10. The fixing device according to claim 8, wherein the support fixedly supports the shield at a position opposite the support via the heat source.

11. The fixing device according to claim 1, wherein the shield includes a reflection surface opposed to the heat source, the reflection surface to reflect the heat or light radiated from the heat source.

12. An image forming apparatus comprising the fixing device according to claim 1.

13. The fixing device according to claim 1, wherein the fixing belt includes a base made of metal.

14. The fixing device according to claim 13, wherein the base of the fixing belt is made of nickel.

15. The fixing device according to claim 13, wherein the base of the fixing belt is made of SUS (steel use stainless).

16. The fixing device according to claim 1, wherein the fixing belt includes a base made of resin.

17. The fixing device according to claim 16, wherein the base of the fixing belt is made of polyimide.

18. The fixing device according to claim 1, wherein the shield is disposed opposite the reflector.

19. The fixing device according to claim 1, wherein the heat source is interposed between the reflector and the shield.

20. The fixing device according to claim 1, wherein the heat source does not heat the nip directly.

21. The fixing device according to claim 8, wherein the shield is disposed between the fixing belt and the heat source, and the shield is disposed opposite the support via the heat source.

22. A fixing device comprising:

a rotary endless fixing belt;

a nip forming member disposed in an interior of the fixing belt;

a rotary opposed member disposed to contact the nip forming member via the fixing belt to form a nip together with the fixing belt;

a heat source to heat the fixing belt directly at a portion other than the nip, the heat source including a heat generating portion disposed outside a maximum passing area of a recording medium passing through the nip;

a belt support member to rotatably support both lateral ends of the fixing belt;

a shield that shields heat or light radiated from the heat source, the shield being fixedly disposed between the fixing belt and the heat generating portion of the heat source and between the belt support member and the heat source at least outside the maximum passing area of the recording medium, the shield being inserted inside the belt support member and fixedly disposed between the belt support member and the heat source at a position opposite the nip via the heat source; and a reflector fixedly supporting the shield to reflect the heat or light radiated from the heat source.

23. A fixing device comprising:

a rotary endless fixing belt;

a nip forming member disposed in an interior of the fixing belt;

a rotary opposed member disposed to contact the nip forming member via the fixing belt to form a nip together with the fixing belt;

a heat source to heat the fixing belt directly at a portion other than the nip, the heat source including a heat generating portion disposed outside a maximum passing area of a recording medium passing through the nip;

a belt support member to rotatably support both lateral ends of the fixing belt; and a shield that shields heat or light radiated from the heat source, the shield being fixedly disposed between the fixing belt and the heat generating portion of the heat source and between the belt support member and the heat source at least outside the maximum passing area of the recording medium, the shield being inserted inside the belt support member and fixedly disposed between the belt support member and the heat source at a position opposite the nip via the heat source, wherein the shield includes a notch notched from an end to a center of the fixing belt in a shaft direction of the fixing belt.

24. A fixing device comprising:

a rotary endless fixing belt;

a nip forming member disposed in an interior of the fixing belt;

a rotary opposed member disposed to contact the nip forming member via the fixing belt to form a nip together with the fixing belt;

a heat source to heat the fixing belt directly at a portion other than the nip, the heat source including a heat generating portion disposed outside a maximum passing area of a recording medium passing through the nip;

a reflector to reflect heat or light radiated from the heat source;

a belt support member to rotatably support both lateral ends of the fixing belt;

a shield that shields the heat or light radiated from the heat source, the shield being fixedly disposed between the fixing belt and the heat generating portion of the heat source, and the shield including a through-hole; and a stay that supports the shield.

25. The fixing device according to claim 24, wherein the shield is fixedly disposed between the belt support member and the heat source at least outside the maximum passing area of the recording medium.

26. The fixing device according to claim 24, wherein a part of the heat generation portion is disposed inside the belt support member.

27. The fixing device according to claim 24, wherein the through-hole of the shield is disposed at a portion nearer to a center of the fixing belt than to the lateral ends of the fixing belt.

* * * * *